United States Patent [19]

Jayne

[11] 4,085,990

[45] Apr. 25, 1978

[54] LONGITUDINALLY ACTUATED ZERO FORCE CONNECTOR

[75] Inventor: Max Leroy Jayne, North Warren, Pa.

[73] Assignee: GTE Sylvania, Incorporated, Stamford, Conn.

[21] Appl. No.: 781,295

[22] Filed: Mar. 25, 1977

[51] Int. Cl.[2] ..... H01R 13/62

[52] U.S. Cl. ..... 339/74 R

[58] Field of Search ..... 339/74 R, 75 MP, 176 MP

[56] References Cited

U.S. PATENT DOCUMENTS

| | | | |
|---|---|---|---|
| 3,596,230 | 7/1971 | Ecker | 339/74 R |
| 3,665,370 | 5/1972 | Hartmann | 339/75 MP |
| 3,818,419 | 6/1974 | Crane | 339/74 R |
| 3,897,991 | 8/1975 | Pritulsky | 339/75 MP |

*Primary Examiner*—Neil Abrams

*Attorney, Agent, or Firm*—John C. Fox

[57] ABSTRACT

An edge connector for a printed circuit board including an actuator plate comprising at least one cam surface and at least one contact holder comprising at least one cam follower. Movement of the actuator plate along the longitudinal axis of the connector forces the contact holder away from the longitudinal axis when the high point of an adjacent cam surface engages the cam follower and allows the contact holder to move towards the longitudinal axis when the low point of an adjacent cam surface engages the cam follower.

11 Claims, 4 Drawing Figures

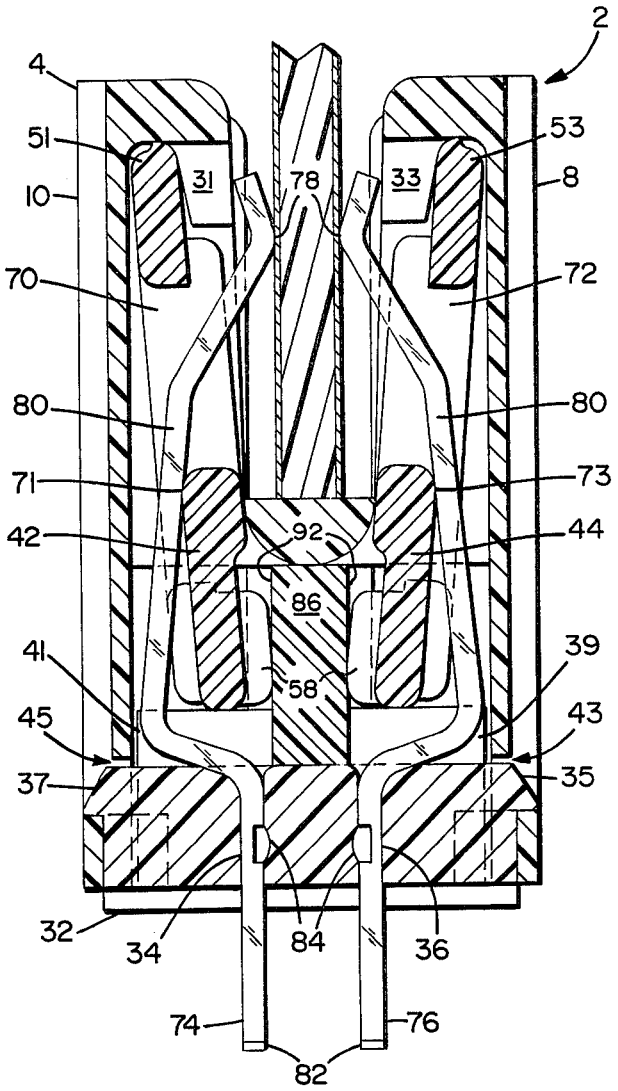
Fig. 2
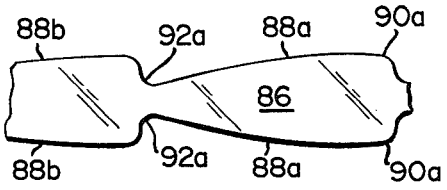
Fig. 4
Fig. 3
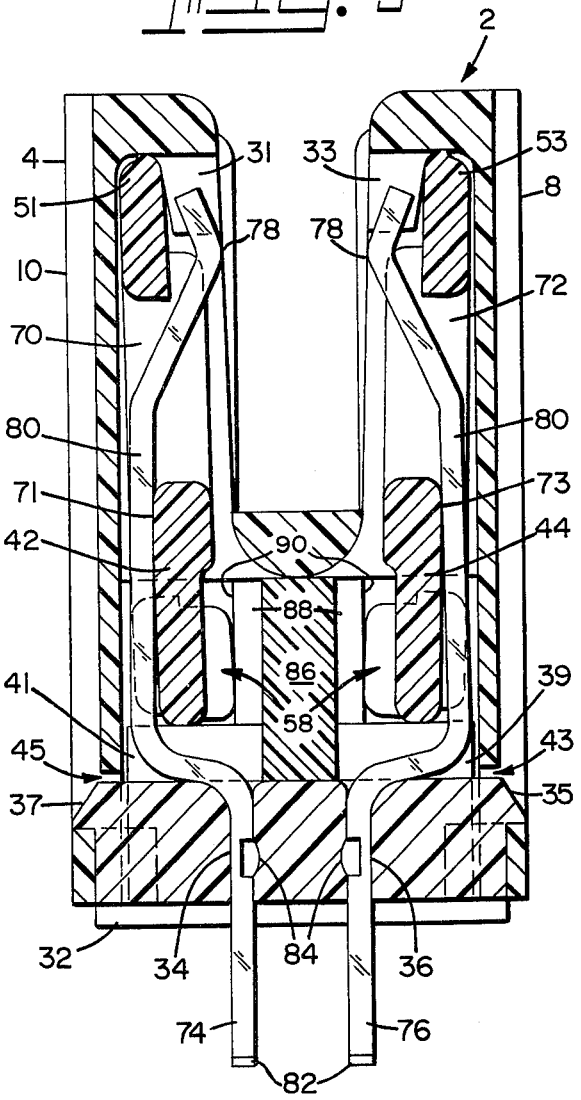

LONGITUDINALLY ACTUATED ZERO FORCE CONNECTOR

BACKGROUND OF THE INVENTION

1. Field of the Invention

The present invention relates to an electrical connector and, more particularly, to a longitudinally actuated zero force electrical connector in which the longitudinal movement of an actuator plate forces opposing contact holders and contacts engaging such holders apart when the high point of a cam surface which forms a part of the actuator plate engages a corresponding cam follower which forms a part of each contact holder. Similarly, such longitudinal movement allows the opposing contact holders and contacts to move toward each other when the low point of the cam surface engages the cam follower.

2. Description of Prior Art

Prior art attempts have been made to reduce or eliminate the contact between the terminals of a printed circuit board and opposing electrical contacts when the board is inserted into a connector of the type used to interconnect the connector's resilient contact members with the board terminals. For example, in U.S. Pat. No. 3,710,303 a connector is provided having means to shift the contact elements out of the insertion path of the circuit board as a result of the engagement, during insertion, between the circuit board and cam projections which form part of the connector. In the structure described, such cam projections extend further inward from the channel walls of the housing of the connector than do the contacts. When a circuit board is inserted into the channel the board engages the projections and displaces the projections away from the longitudinal axis of the channel. Due to the interrelationship between the projections and the contacts, the displacement of the projections causes a corresponding displacement of the contacts such that the contacts are displaced out of the path of the board. When the board is completely inserted into the connector, the cam projections enter recesses in the board. Such movement of the projections into the recesses causes corresponding movement of the contacts into engagement with the surface of the board, thereby electrically connecting the contacts to the board terminals. Although such devices reduce the contact between the board terminals and the connector contacts, the physical engagement between the board and the cam projections may require that more force than is desired be exerted to insert or remove the board in some applications.

In U.S. Pat. No. 3,478,301 an electrical connector is provided in which only after partial insertion of the printed circuit board is engagement of the connector contacts with the board contact terminals effected. In this structure, an elongated hollow body which forms the connector receptacle includes therein cam means which are actuated automatically by the insertion of a printed circuit board to displace resilient contacts into engagement with corresponding circuit board terminals. In operation, even though the circuit board has been partially inserted into the connector receptacle, there is no engagement with the contacts. After partial insertion, continued insertion causes the printed circuit board to actuate the cam means such that the board engages levers or lugs thereby pivoting cam lobes which bring resilient contact fingers into engagement with circuit board terminals. By moving the circuit board further into the receptacle toward the final position of the board, the contacts effect a wiping action against the terminals until the contacts are locked in resilient engagement with corresponding terminals. Although such devices eliminate the contact between the board terminals and the connector contacts as the board is being initially inserted into the connector, the physical engagement between the board terminals and connector contacts as the board is moved further into the connector may require that more force than is desired be exerted to complete the insertion and lock the contacts in engagement with the terminals. Similarly, such engagement may require relatively more force than is desired to remove the board from the connector and may cause undesirable wear of the contacts and board terminals.

Efforts have been made to provide a zero force connector in which the engagement of the connector contacts with the printed circuit board terminals is not effected until after the board has been inserted in the connector to the extent desired. For example, in U.S. Pat. No. 3,475,717 a zero force connector is provided having actuator plates which are slidably disposed within the connector housing to engage and disengage the resilient contacts per se. When the actuator plate engages such contacts, it flexes the contacts into engagement with the printed circuit board terminals. When the actuator plate is disengaged from such contacts, the inherent resiliency of the contacts causes the contacts to be biased away from the printed circuit board terminals. Although such a device may reduce the force required to insert a terminal board into a connector, inherent in the operation of such connectors is undesirable engagement between the actuator plates and the connector contacts.

Finally, in U.S. Pat. No. 3,526,869, a cam actuated connector is provided which includes an actuating cam, the rotation of which causes a bearing surface to engage an actuating surface to thereby move an actuating housing in a longitudinal direction. The housing comprises ramp sections which slide, as a result of such longitudinal movement, relative to ramp portions of actuator spacers to cause the actuator spacers to move inwardly or outwardly relative to the longitudinal axis of the housing. Such movement of the spacers causes corresponding movement of the contacts which engage the terminals of the printed circuit board. Although such a device may reduce the force required to insert a terminal board into a connector, the operation of this device requires a mechanism whereby rotational motion must be translated into longitudinal motion.

In addition to all of the foregoing, some prior art connectors have not proved to be totally satisfactory in that they have not been constructed to hold up under continuous use. Other prior art connectors have included complex structures which require that the connector be larger than desired.

It is therefore one of the objects of the present invention to provide a connector which will permit substantial reduction, or elimination, of the engagement between the terminals of a printed circuit board and opposing electrical contacts of the connector except for such time as the board is inserted into the connector to the extent desired.

Another object of the present invention is to provide a connector the use of which requires a minimum amount of force to insert a printed circuit board therein, or remove it therefrom.

A further object of the present invention is to provide a connector wherein the physical contact between the connector contacts and board terminals is substantially reduced except for such time as the board is inserted into the connector to the extent desired.

Yet a further object of the present invention is to provide a connector wherein any undesirable wear of the board terminals or connector contacts is substantially reduced.

Yet another object of the present invention is to provide a connector which does not require the translation of rotational motion into longitudinal motion during operation.

A further object of the present invention is to provide a connector which may be readily miniaturized.

Yet a further object of the present invention is to provide a connector which is simple in construction and durable even when subjected to continued use.

Another object of the present invention is to provide a cam surface which varies from its high point to low point in such a manner that the associated contacts are caused to move, relative to the longitudinal axis of the connector, more slowly as the contacts are deflected away from such longitudinal axis and the load in the resilient contacts is thereby increased.

A further object of the present invention is to provide means for guiding the actuator plate to facilitate longitudinal movement thereof.

Yet a further object of the present invention is to provide means to limit the stroke of the actuator plate along the longitudinal axis.

Yet another object of the present invention is to provide a connector into which a printed circuit board may be inserted either vertically (from above) or horizontally (from the side).

These and other objects will become apparent from the detailed discussion which follows and from the accompanying drawings.

SUMMARY OF THE INVENTION

Generally, the electrical connector of the present invention comprises a hollow support member within which is positioned at least one contact holder which extends along the support members' longitudinal axis. The internal surface of the contact holder includes a cam follower. At least one resilient electrical contact engages the contact holder and urges the holder toward said longitudinal axis. An actuator plate is slidingly affixed within the support member. In order to cause the actuator plate to slide relative to the support member, a portion of the plate extends through an aperture in the support member to provide a portion of the plate outside of the support member. The actuator plate comprises at least one cam surface which extends into the support member and engages the associated cam follower and which has a high point and a low point.

In operation, by sliding the actuator plate along the longitudinal axis of the support member, a contact holder and contacts affixed thereto are urged away from the longitudinal axis by a pivotal movement as the high point of the cam surface engages the associated cam follower of the contact holder. The connector is desirably designed such that the distance between the contacts and the longitudinal axis of the connector is such that a printed circuit board can be inserted into the connector without engaging the contacts as each cam follower engages the high point of its associated cam surface. Accordingly, the printed circuit board can be inserted into the connector without any appreciable frictional engagement between the two. Furthermore, such insertion can be either vertically (from above), or horizontally (from the side). After the board has been inserted into the connector, the actuator plate is similarly slid along the longitudinal axis, and a contact holder and contacts affixed thereto are pivotally urged toward the longitudinal axis as the low point of the cam surface engages its associated cam follower. Such movement causes the contacts to electrically and physically engage the terminals of the board.

BRIEF DESCRIPTION OF THE DRAWINGS

In the drawings wherein like reference characters denote corresponding parts throughout the several views:

FIG. 2 is a sectional view of the embodiment of the connector of FIG. 1 and depicts the contacts as being in the forward position relative to the circuit board inserted into the connector.

FIG. 3 is a sectional view of the embodiment of the connector of FIG. 1 and depicts the contacts as being in the retracted position relative to the circuit board to be inserted into the connector.

FIG. 4 is a plan view of the portion of the actuator plate designated "A" in FIG. 1.

DESCRIPTION OF THE PREFERRED EMBODIMENTS

Figure 1:
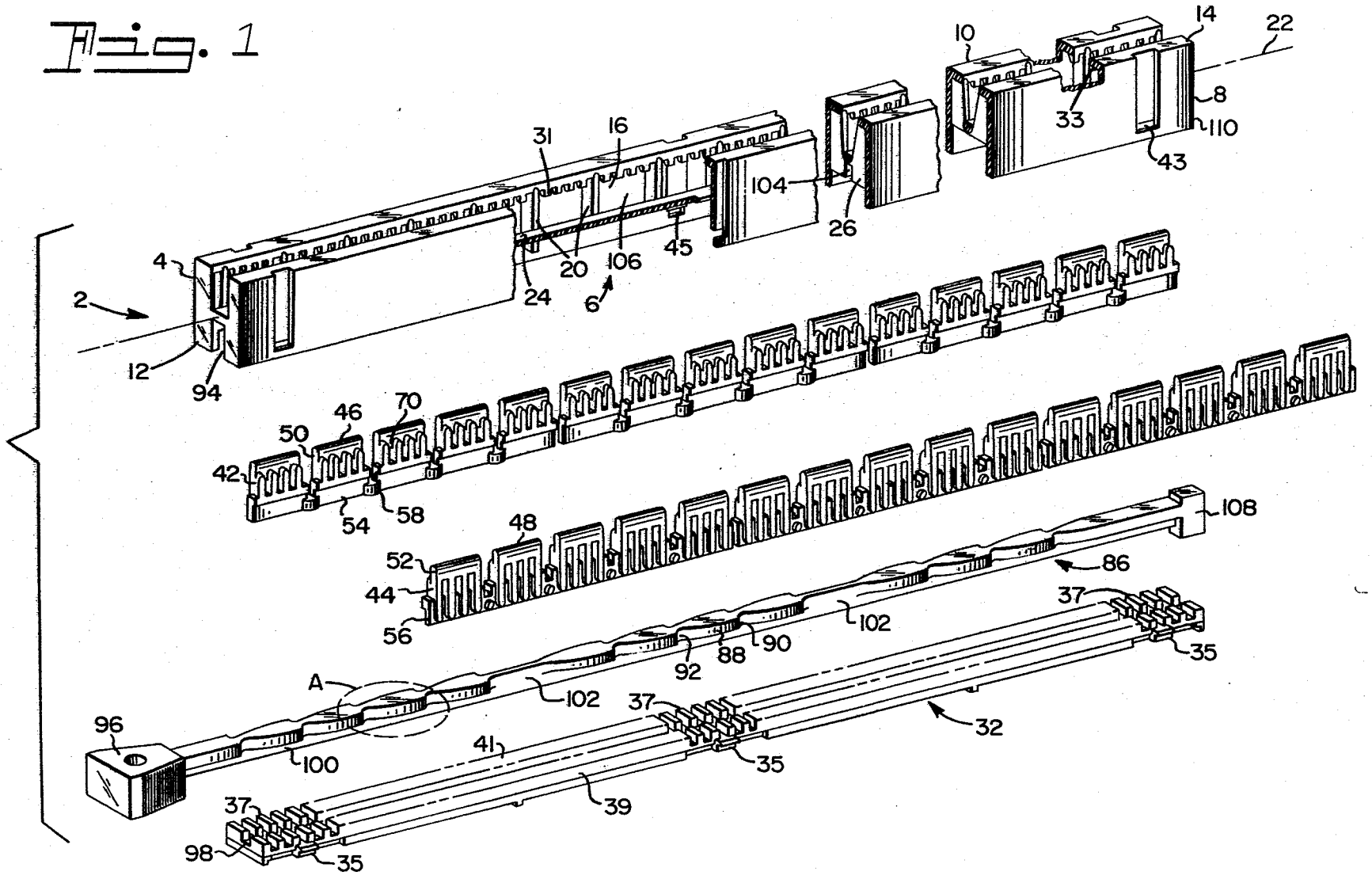
FIG. 1 is an exploded view of one embodiment of the connector of the present invention.

FIG. 1 depicts an exploded view of one embodiment of the longitudinally actuated connector of the present invention. The embodiment depicted and described herein is of the type which includes opposing contact holders and opposing resilient contacts which are urged towards or away from each other and any printed circuit board to be inserted into the connector in response to movement of an actuator plate along the longitudinal axis of the connector, as described herein. However, the present invention is not meant to be limited to such structures and includes those connectors having at least one contact holder and at least one resilient contact which are urged towards and away from the longitudinal axis of the connector, and any printed circuit board to be inserted into the connector, in response to movement of an actuator plate along said longitudinal axis, as described herein. The connector 2 comprises a hollow support member 4, the hollow portion 6 of which is formed by side walls 8 and 10 connected to end walls 12 and 14. The connection of the side walls to the end walls may be inherent in the structure as a result of a manufacturing process such as, for example, a molding process during which all of the walls are rendered integral with each other. Alternatively, the end and side walls may be individually produced and subsequently affixed to each other. In the preferred embodiment the hollow portion 6 comprises opposing chambers 16 and 18 (not shown). Chambers 16 are formed by interior walls 20 which extend generally perpendicular to the longitudinal axis 22 of support member 4, and interior flange 24 which extends along said longitudinal axis. Similarly, chambers 18 are formed by interior walls 26 and flange 24. The side walls 8 and 10 also extend along the longitudinal axis 22 of support member 4. Support member 4 also includes lips 31 and 33 which extend along said longitudinal axis. The bottom 32 of support member 4 includes two rows of apertures which extend therethrough. As depicted in FIG. 2, in the preferred embodiment the rows are aligned such that apertures 34 and 36 are aligned in the longitudinal direction relative to each other. Alternatively, the rows may be staggered in which case apertures 34 and 36 would be offset in the longitudinal direction relative to each other. In the preferred embodiment there is a plurality of apertures 34 and 36 which extend through the base 32 into hollow portion 6.

Although not necessary, preferably the base 32 is formed separately from support member 4 and is affixed to support member 4 to complete the assembly of the connector 2. For example, base 32 may be provided with lugs 35 and 37 (not shown) which protrude from the side surfaces 39 and 41 of the base 32. Similarly, side walls 8 and 10 are provided with apertures 43 and 45 which mate with lugs 35 and 37, respectively. In this manner, when the lugs are inserted in the apertures, the base may be snapped in place so that the base cannot be readily removed from the support member.

Opposing contact holders 42 and 44 extend along said longitudinal axis and include projections 46 and 48 which may be inserted into corresponding chambers 16 and 18. Contact holders 42 and 44 each also include edge portions 50 and 52 extending along said longitudinal axis and in mating relationship with lips 31 and 33, respectively, to provide pivot areas 51 and 53 for contact holders 42 and 44. The opposing internal surfaces 54 and 56 of contact holders 42 and 44 comprise opposing cam followers **58*a* and 58*b* (not shown). Each projection 46 and 48 comprises a plurality of apertures 70 and 72 which extend therethrough and also includes a bearing surface 71 and 73**.

Resilient electrical contacts 74 and 76 are provided, each of which comprises a contact point 78 which extends towards said longitudinal axis, a concave portion 80 which extends away from said longitudinal axis, and an end portion 82. Contacts 74 and 76 extend through apertures 70 and 72 in contact holders 42 and 44, respectively, such that contact holders 42 and 44 lie between concave portions 80 and said longitudinal axis and bearing surfaces 71 and 73 engage concave portions 80. Contact points 78 extend through apertures 70 and 72 towards said longitudinal axis, and end portion 82 extends through apertures 34 and 36 in the bottom 32 of the support member 4. Each contact 74 and 76 also includes protrusions 84 which facilitate affixing the contacts 74 and 76 to the support member 4.

An actuator plate 86 is provided which includes cam surfaces 88 having opposing high points 90 and opposing low points 92. Cam surfaces 88 engage the associated cam followers 58. Actuator plate 86 is slidingly affixed internal of support member 4 and extends through an aperture 94 to provide an end portion 96 outside of the support member 4 by means of which the plate may be moved along the longitudinal axis. Such longitudinal movement is faciliated by providing a groove 98 in base 32 which mates with tongue 100 of actuator plate 86. In addition, actuator plate 86 may be provided with ribbed portions 102 which mate with apertures 104 in support member 4. Interior flange 24 is adjacent to an aperture 106 through which a projection 46 of contact holder 42 extends. Actuator plate 86 is also provided with a stop member 108 which extends outside of the support member 4 through an aperture 110 (not shown) in the support member. By providing a stop member 108 which is larger than aperture 110 and an end portion 96 which is larger than aperture 94, the degree of longitudinal movement of actuator plate 86 may be controlled. For example, in viewing FIG. 1, actuator plate 86 may be slid from right-to-left internal of support member 4 along the longitudinal axis 22 until such time as stop member 108 bears against end wall 14 and may be similarly slid left-to-right until such time as end portion 96 bears against end wall 12.

Although not necessary, preferably the cam surfaces vary from their high point 90 to their low point 92 in such a manner that the associated contacts may be moved, relative to the longitudinal axis 22, increasingly more slowly as the contact points are deflected away from said longitudinal axis and the load in the resilient contacts 74 and 76 is thereby increased. For example, as depicted in FIG. 4 which is a plan view of the portion of the actuator plate 86 designated "A" in FIG. 1, cam surface **88*a* has a variable rise from its low point 92*a* to its high point 90*a*. The same is true regarding cam surface 88*b*. In the particular embodiment depicted in FIG. 4, the slope of the curve outlined by surface 88*a* decreases as high point 90*a* is approached from low point 92*a*. The rate of decrease increases as high point 90*a* is approached, and such increase in the rate of change of slope accounts for the decrease in the rate of deflection of the contacts as they approach their fully deflected position. Of course, the rate of change in the slope may be varied as desired to control the rate of deflection of the contacts relative to the longitudinal axis 22**.

By providing an actuator plate 86 as described herein, movement of the actuator plate along the longitudinal axis 22 forces the opposing contact holders 42 and 44 away from such longitudinal axis or apart when the cam high points 90 engage the cam followers 58 and allows such opposing contact holders to move towards each other or the longitudinal axis when the cam low points 92 engage the cam followers 58.

In operation, the actuator plate 86 is moved along the longitudinal axis 22 and the high points 90 of the cam surfaces 88 ultimately engage their associated cam followers. During such movement bearing surfaces 71 and 73 bear against their associated contacts 74 and 76 at the concave portions 80 to cause the opposing contact holders and resilient contacts to pivot away from each other about pivot points 51 and 53 until such time as the distance between the opposing contact points 78 of opposing contacts 74 and 76 is such that a printed circuit board can be inserted into the connector without engaging the contacts. When the board is inserted to the extent desired the actuator plates are again moved along the longitudinal axis 22, only this time in the opposite direction, until the low points 92 of the cam surfaces 88 engage their associated cam followers. During such movement bearing surfaces 71 and 73 release the pressure exerted against their associated contacts 74 and 76 to allow the opposing contact holders and resilient contacts to pivot toward each other about pivot points 51 and 53 in such a manner that the opposing contact points 78 of opposing contacts 74 and 76 ultimately physically and electrically bear against the board terminals. The movement of the contacts toward the circuit board results from the inherent resiliency of the contacts.

The embodiment which has been described herein is but one of serveral which utilize this invention and is set forth here by way of illustration but not of limitation. It is apparent that many other embodiments which will be readily apparent to those skilled in the art may be made without departing materially from the spirit and scope of this invention.

I claim:

1. A longitudinally actuated connector comprising:

a hollow support member having two side walls which extend along the longitudinal axis of said member and are connected by two end walls;

at least one contact holder positioned within said support member and extending along said longitudinal axis, the internal surface of said holder including at least one cam follower and wherein said contact holder includes at least one edge portion extending along said longitudinal axis and at least one of said side walls includes a lip to provide pivot point;

at least one resilient electrical contact engaging said holder, said contact urging said cam follower toward said longitudinal axis; and, at least one actuator plate slidingly affixed internal of said support member, said plate including at least one cam surface which engages said cam follower and includes a high point and a low point, said actuator plate extending through an aperture in said support member to provide a portion outside of said support member by means of which said plate may be moved along said longitudinal axis, said movement forcing said contact holder and contacts engaging said holder away from said longitudinal axis by pivotal movement of the contact holder about said pivot point as said high point approaches said cam follower and allowing said contact holder and contacts engaging said holder to move towards said longitudinal axis by pivotal movement of the contact holder about said pivot point in a reverse direction as said low point approaches said cam follower.

2. The device of claim 1 including at least two opposing contact holders positioned within said support member and extending along said longitudinal axis, the opposing internal surface of said holders including opposing cam followers, said resilient electrical contacts engaging each of said holders and urging said opposing cam followers toward said longitudinal axis and therefore toward each other; and, at least two of said cam surfaces, each engaging an opposing cam follower, said longitudinal movement forcing said opposing contact holders and contacts engaging said holders apart by pivotal movement of said contact holders as said high points approach said cam followers and allowing said opposing contact holders and contacts engaging said holders to move towards each other by pivotal movement of the contact holders in a reverse direction as said low points approach said cam followers.

3. The device of claim 2 wherein said support member comprises a plurality of chambers and said contact holders include a plurality of projections which extend into said chambers.

4. The device of claim 3 wherein each of said projections comprise a plurality of apertures through which said contacts extend.

5. The device of claim 1 wherein said cam surface varies from said high point to said low point such that the slope of the curve outlined by said surface decreases as said high point is approached from said low point.

6. The device of claim 5 wherein the rate of said decrease increases as said high point is approached.

7. The device of claim 1 wherein said support member includes a first aperture through which a first end of said actuator plate extends to provide an end portion outside of said support member by means of which said plate may be moved along said longitudinal axis.

8. The device of claim 7 wherein said support member includes a second aperture through which the end of said actuator opposite said first end extends to provide a second end portion outside of said support member, said second end portion including a stop member.

9. The device of claim 1 wherein said actuator plate and said support member include means which mate with each other for facilitating said longitudinal movement.

10. A longitudinally actuated connector comprising:

a hollow support member including a plurality of chambers and having two side walls which extend along the longitudinal axis of said member and being connected by two end walls, at least one of said side walls including a lip, and said support member including a first aperture in one of said end walls and a second aperture in the other of said end walls;

at least one contact holder positioned within said support member and extending along said longitudinal axis, said holder including a plurality of projections which extend into said chambers and at least one edge portion which extends along said longitudinal axis and mates with said lip to provide a pivot area about which said holder may pivot, the internal surface of said holder including at least one cam follower and each of said projections having a plurality of apertures;

a plurality of resilient electrical contacts engaging said holder, each of said contacts extending through one of said apertures in said projections and urging said cam follower toward said longitudinal axis; and, at least one actuator plate slidingly affixed internal of said support member and having a first end which extends through said first aperture to provide an end portion outside of said support member by means of which said plate may be moved along said longitudinal axis, and having an end opposite said first end which extends through said second aperture to provide a second end portion outside of said support member, said second end portion including a stop member, said plate including at least one cam surface which engages said cam follower and varies from a high point to a low point such that the slope of the curve outlined by said surface decreases as said high point is approached from said low point and the rate of said decrease increases as said high point is approached; and, means internal of said support member which mate with said actuator plate for facilitating said longitudinal movement, said longitudinal movement forcing said contact holder and contacts engaging said holder away from said longitudinal axis by pivotal movement of said contact holder at said pivot area as said high point approaches said cam follower and allowing said contact holder and contacts engaging said holder to move towards said longitudinal axis by pivotal movement of said contact holder at said pivot area in a reverse direction as said low point approaches said cam follower.

11. The device of claim 10 including at least two opposing contact holders positioned within said support member and extending along said longitudinal axis, the opposing internal surfaces of said holders including opposing cam followers, said resilient electrical contacts engaging each of said holders and urging said opposing cam followers toward said longitudinal axis and therefore toward each other; and, at least two of said cam surfaces, each engaging an opposing cam follower, said longitudinal movement forcing said opposing contact holders and contacts engaging said holders apart by pivotal movement of said contact holders as said high points approach said cam followers and allowing said opposing contact holders and contacts engaging said holders to move towards each other by pivotal movement of the contact holders in a reverse direction as said low points approach said cam followers.

* * * * *